US009721428B1

(12) United States Patent
Xu

(10) Patent No.: US 9,721,428 B1
(45) Date of Patent: Aug. 1, 2017

(54) DELAYED, GAME-TRIGGERED ONLINE GAME PLATFORM REGISTRATION

(71) Applicant: KABAM, INC., San Francisco, CA (US)

(72) Inventor: Ziqiang Xu, Belmont, CA (US)

(73) Assignee: Aftershock Services, Inc., San Francisco, CA (US)

( * ) Notice: Subject to any disclaimer, the term of this patent is extended or adjusted under 35 U.S.C. 154(b) by 749 days.

(21) Appl. No.: 14/099,584

(22) Filed: Dec. 6, 2013

Related U.S. Application Data

(60) Provisional application No. 61/773,012, filed on Mar. 5, 2013.

(51) Int. Cl.
*G07F 17/32* (2006.01)

(52) U.S. Cl.
CPC ..... *G07F 17/3241* (2013.01)

(58) Field of Classification Search
None
See application file for complete search history.

(56) References Cited

U.S. PATENT DOCUMENTS

| | | | | |
|---|---|---|---|---|
| 8,663,004 | B1 | 3/2014 | Xu | |
| 2001/0039210 | A1* | 11/2001 | St-Denis | G06Q 30/02 463/42 |
| 2003/0054878 | A1* | 3/2003 | Benoy | G07F 17/3209 463/29 |
| 2003/0181242 | A1* | 9/2003 | Lee | A63F 13/12 463/42 |
| 2004/0106449 | A1 | 6/2004 | Walker et al. | 463/25 |
| 2008/0194332 | A1 | 8/2008 | Kadikario | |
| 2008/0234043 | A1 | 9/2008 | McCaskey et al. | 463/29 |
| 2009/0215512 | A1 | 8/2009 | Gannon | |
| 2009/0276351 | A1 | 11/2009 | Faratin | |
| 2010/0036720 | A1 | 2/2010 | Jain | |
| 2010/0056269 | A1* | 3/2010 | Zalewski | A63F 13/10 463/29 |
| 2010/0107214 | A1 | 4/2010 | Ganz | 726/1 |
| 2011/0258684 | A1 | 10/2011 | Ganz | 726/4 |
| 2012/0004041 | A1* | 1/2012 | Pereira | A63F 9/24 463/42 |
| 2012/0265587 | A1 | 10/2012 | Kinkead | |
| 2013/0005481 | A1* | 1/2013 | Tagawa | A63F 13/75 463/42 |
| 2013/0073388 | A1 | 3/2013 | Heath | |
| 2013/0084936 | A1* | 4/2013 | Pease | G07F 17/32 463/18 |

(Continued)

OTHER PUBLICATIONS

Codeweavers, Chapter 3 (May 29, 2010) https://web.archive.org/web/20100529073325/http://www.codeweavers.com/support/docs/crossover-games-mac/in ; Chapter 4 (Jun. 12, 2010) https://web.archive.org/web/20100612161758/http://www.codeweavers.com/support/docs/crossover-games-mac/demo , pp. 1-2.*

*Primary Examiner* — Tramar Harper
(74) *Attorney, Agent, or Firm* — Sheppard Mullin Richter & Hampton LLP

(57) ABSTRACT

This disclosure relates to enabling a user to access a game hosted on a game platform without registering a platform account. In implementations, a game provider may set a game trigger based on an instance of a game. In response to a determination that the game trigger is met, instructions effectuating presentation of a platform registration request to a user may be transmitted to a platform provider.

14 Claims, 3 Drawing Sheets

(56) References Cited

U.S. PATENT DOCUMENTS

| | | | |
|---|---|---|---|
| 2013/0097509 | A1 | 4/2013 | Gomes |
| 2013/0102372 | A1 | 4/2013 | Lutnick |
| 2013/0116038 | A1 | 5/2013 | Alderucci |
| 2013/0117832 | A1 | 5/2013 | Gandhi |
| 2013/0337898 | A1 | 12/2013 | Kelly |
| 2014/0075004 | A1 | 3/2014 | Vandusen |
| 2014/0121007 | A1 | 5/2014 | Santini |
| 2014/0179434 | A1 | 6/2014 | Xu |

* cited by examiner

DELAYED, GAME-TRIGGERED ONLINE GAME PLATFORM REGISTRATION

CROSS-REFERENCE TO RELATED APPLICATIONS

This application claims the benefit of U.S. Provisional Patent Application Ser. No. 61/773,012, entitled "Delayed, Game-Triggered Online Game Platform Registration", filed Mar. 5, 2013, which is hereby incorporated by reference into the present disclosure in its entirety.

FIELD OF THE DISCLOSURE

This disclosure relates to game-triggered platform account registration for online games, in which a platform registration request for a user is generated in response to satisfying a game trigger set by a game provider.

BACKGROUND

Conventional online games are provided through gaming platforms, such as Facebook.com, Kabam.com, Zynga.com, Bigpoint Games, Steam, etc. Individual games that are accessed through the gaming platform may automatically create user accounts that are linked to an over-arching platform account for the users. For example, a platform account for a user may be linked to a host of individual game-level accounts for the user. By linking individual game user accounts to the over-arching platform account for a user, the user is able to login to a gaming platform and access the individual games that are associated with the gaming platform.

However, conventional gaming platforms do not enable a user to access individual games until the user has initially registered a platform account for the user. This requirement creates a barrier to entry for new users to access an individual game. In conventional gaming platforms, although an individual game may intrigue a user, the requirement that the user register for an account before being able to access the game may dissuade or discourage the user from accessing the game.

Accordingly, alternative approaches regarding accessing online games may lower the barrier for users to access a game, and may enable users to access games without first creating an account.

SUMMARY

One aspect of this disclosure relates to enabling user access to a game without the user first registering for a platform account.

In implementations, a system may include a game provider with one or more processors configured to execute computer program modules. The computing modules may include a platform request reception module, a game module, a communication module, a game trigger module, and a platform account registration initiation module.

The platform request reception module may be configured to receive platform requests to provide access for users to the game. The platform requests may include a first platform request to provide access for a first user to the game. The first platform request may indicate that the first user is not registered to a platform account.

The game module may be configured to execute an instance of the game and to use the instance of the game to provide access to the game for the first user in response to the first platform request. The game module may be configured to implement in-game actions in the instance of the game in response to action requests for the in-game actions by the first user.

The communication module may be configured to obtain action requests input by users, wherein the action requests specify execution of in-game actions by the first user.

The game trigger module may be configured to determine if a game trigger for the first user is met based on the instance of the game.

The platform account registration initiation module may be configured to transmit instructions to a platform provider in response to a determination that the game trigger is met. The instructions may effectuate presentation of a platform registration request to the first user by the platform provider.

In implementations, the platform requests include associated identifiers. The game module may be configured to create a game account for the first user associated with the platform request's associated identifier.

In implementations, the platform account registration module may be configured to receive from the platform provider an indication as to whether stated information was received from the first user in response to the presentation of the platform registration request to the first user by the platform provider. The game trigger module may be configured to set a new game trigger in response to an indication that the stated information was not received from the user. In implementations, the game module may be configured to discontinue the instance of the game in response to an indication that the stated information was not received from the first user.

In implementations, the game trigger may be associated with an amount of time that the instance of the game is presented to the first user. In implementations, the game trigger may be associated with in-game actions performed by the first user, the first user's progress towards an in-game achievement, and/or an in-game purchase by the first user.

These and other features and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural references unless the context dearly dictates otherwise.

DETAILED DESCRIPTION

Figure 1:
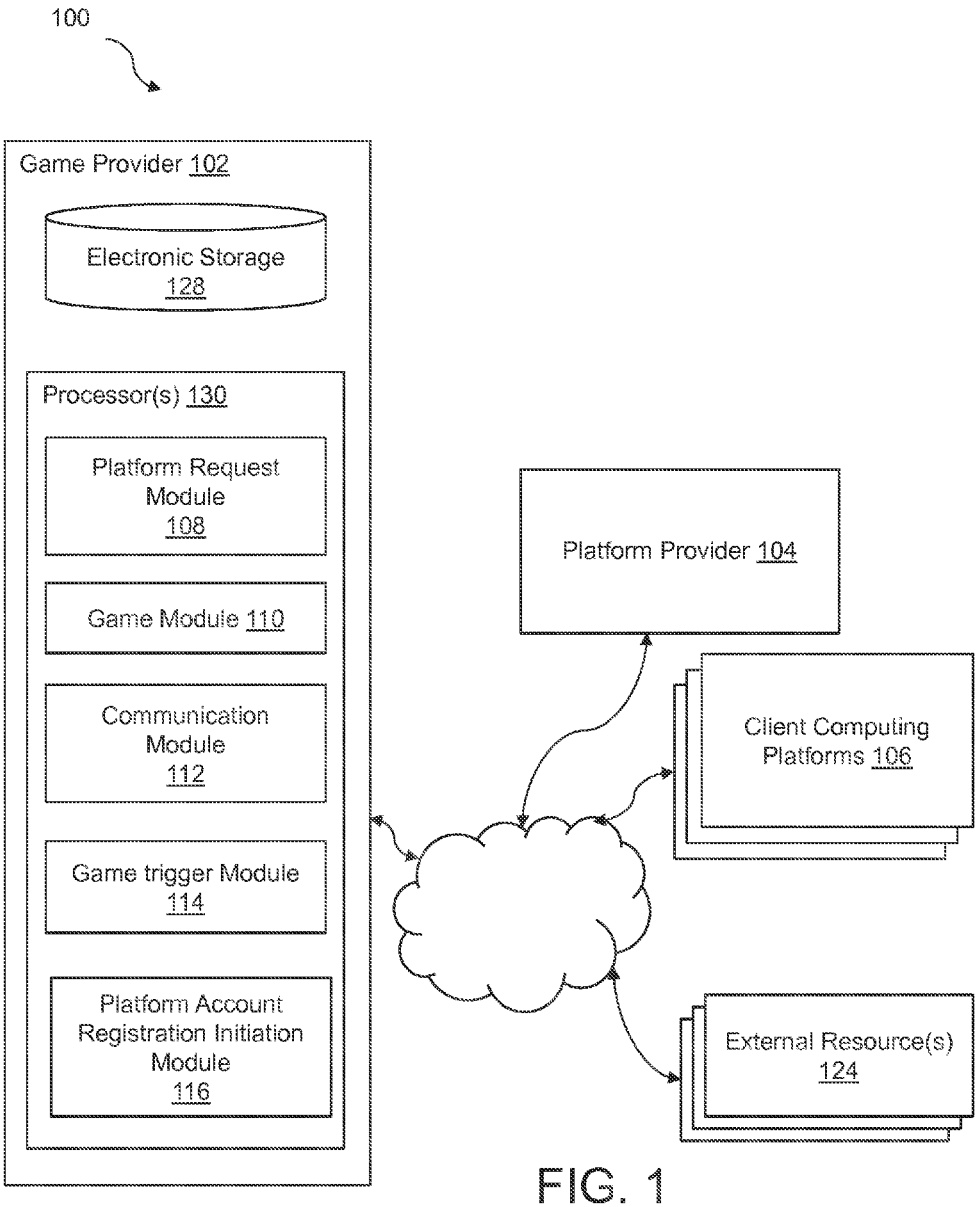
FIG. 1 illustrates a system configured to facilitate registering a platform account for a user, in accordance with one or more implementations.

FIG. 1 illustrates a system 100 configured to provide a virtual space to users. Providing the virtual space may include hosting the virtual space over a network. In some implementations, system 100 may include a game provider 102, platform provider 104, and one or more client computing platforms 106. The game provider 102 and the platform provider 104 may be configured to communicate with each other and/or with one or more client computing platforms 106 according to a client/server architecture. Users may access system 100, game provider 102, platform provider 104 and/or the virtual space via client computing platforms 106.

System 100 is only one example of a suitable computing environment and is not intended to suggest any limitation as to the scope of use or functionality of the features described herein. Providing the virtual space may include hosting the virtual space over a network. In this disclosure, a game provider 102 may be configured to provide access to a game and create game accounts for users that are not registered to a platform account with the platform provider 104. Responsive to a determination that a game trigger is met, game provider 102 may transmit instructions effectuating presentation of a platform registration request for an unregistered user to register a platform account. Accordingly, implementations may be configured to enable users to access a game without the user first registering a platform account.

The game provider 102 may be an online game provider configured to execute one or more computer program modules. In implementations, game provider 102 may be configured to receive user requests to provide access to online games to users from the platform provider 104. The computer program modules may include one or more of a platform request reception module 108, a game module 110, a communication module 112, a game trigger module 114, and a platform account registration initiation module 116. As noted, the client computing platform(s) 106 or platform provider 104 may include one or more computer program modules that are the same as or similar to the computer program modules of the game provider 102 to facilitate registering a user to a gaming platform.

The platform request reception module 108 may be configured to receive platform requests to provide users with access to an online game associated with game provider 102. The received platform requests may include a request to provide access to an online game hosted by game provider 102. In implementations, the received platform request may include data indicating that the user is registered to a platform account or that the user is not registered to a platform account, where the platform account may be associated with platform provider 104 hosting a plurality of games from a plurality of game providers 102. A user registered to a platform account for the platform provider 104 may utilize the platform account to access games provided by game provider 102. A user not registered to a platform account may still access the games provided by game provider 102. Whether a user has registered to a platform account or not, the user may have an associated platform identifier. In implementations, the user's platform identifier may be the same identifier used in a game account for the user.

The game module 110 may be configured to execute an instance of the game. In response to receiving the platform request for the game, game module 110 may implement the instance of the game to provide access to the game to the user, and may also create the game account for the user. The game account may include the platform identifier associated with the user. In implementations, game provider 102 may include a plurality a plurality of game modules 110, where each game module is associated with a different game. In response to receiving action requests for in-game actions input by users, game module 110 may be configured to implement the in-game actions in the instance of the game. Game module 110 may be configured to implement the instance of the game in virtual space executed by the computer modules. The instance of the virtual space may reflect the state of the virtual space. The instance of the virtual space may be used to push state information to clients for implementation on the clients, may be used to verify state information generated on clients executing expressions of the instance locally, and/or for other purposes. State information may include information about the state of the virtual space such as, without limitation, position information of one or more objects, topography information, object status/shape information, battle information, score information, user or character progress information, user inventory information, progress information for one or more activities or actions, view information describing a view of the virtual space, and/or other information that describes the state of the virtual space. Expressions of the instance executed on the clients facilitate presentation of views on the clients of the virtual space. Expressions of the instance executed on the clients may be configured to simply present views of the virtual space based on the state information (e.g., via streaming view information, object/position information, and/or other state information) received from game module 110. Expressions of the instance executed on the clients may include space logic that effectively provides for execution of a limited version of the instance on a client that is synchronized and/or verified with state information received from game module 110. The view presented on a given client may correspond to a location in the virtual space (e.g., the location from which the view is taken, the location the view depicts, and/or other locations), a zoom ratio, a dimensionality of objects, a point-of-view, and/or view parameters. One or more of the view parameters may be selectable by the user.

The instance of the virtual space may comprise a simulated space that is accessible by users via clients (e.g., client computing platforms 106) that present the views of the virtual space to a user. The simulated space may have a topography, express ongoing real-time interaction by one or more users, and/or include one or more objects positioned within the topography that are capable of locomotion within the topography. In some instances, the topography may be a 2-dimensional topography. In other instances, the topography may be a 3-dimensional topography. The topography may include dimensions of the space, and/or surface features of a surface or objects that are "native" to the space. In some instances, the topography may describe a surface (e.g., a ground surface) that runs through at least a substantial portion of the space. In some instances, the topography may describe a volume with one or more bodies positioned therein (e.g., a simulation of gravity-deprived space with one or more celestial bodies positioned therein). The instance executed by the computer modules may be synchronous, asynchronous, and/or semi-synchronous.

The above description of the views of the virtual space determined from the instance executed by game module 110 is not intended to be limiting. The virtual space may be presented in a more limited, or more rich, manner. For example, views of the virtual space may be selected from a limited set of graphics depicting an event in a given place within the virtual space. The views may include additional content (e.g., text, audio, pre-stored video content, and/or other content) that describes particulars of the current state of the place, beyond the relatively generic graphics. For example, a view may include a generic battle graphic with a textual description of the opponents to be confronted. Other representations of individual places within the virtual space are contemplated.

Within the instance of the virtual space executed by game module 110, users may control characters, objects, simulated physical phenomena (e.g., wind, rain, earthquakes, and/or other phenomena), and/or other elements within the virtual space to interact with the virtual space and/or each other. The user characters may include avatars. As used herein, the term "user character" may refer to an object (or group of objects) present in the virtual space that represents an individual user. The user character may be controlled by the user with which it is associated. The user controlled element(s) may move through and interact with the virtual space (e.g., non-user characters in the virtual space, other objects in the virtual space). The user controlled elements controlled by and/or associated with a given user may be created and/or customized by the given user. The user may have an "inventory" of virtual goods and/or currency that the user can use (e.g., by manipulation of a user character or other user controlled element, and/or other items) within the virtual space.

The communications module 112 may be configured to obtain action requests input by users. The actions requests may specify execution of in-game actions performed by game module 110. The in-game actions may be associated with moving or controlling a user controlled element, changing a view of the virtual space, a purchase request, or any other action interacting with the virtual space, such as managing an inventory of virtual goods or currency.

The game trigger module 114 may be configured to determine if a game trigger for the user is met based on the instance of the game. In implementations, the game trigger may be determined by the game provider 102 of the game, and may vary from game to game. Accordingly, a first game may have a game trigger that is different than the game trigger of a second game. The game trigger may be associated with an amount of time that the instance of the game is presented to the user (e.g. one minute, ten minutes, one hour, or any length of time), in-game actions performed by the user (e.g. a user reaching a certain level in-game, completing a tutorial in-game, etc.), the user's progress towards an in-game achievement (e.g. unlocking a trophy, badge, award, stamp medal, challenge, etc.) and/or an receiving a request to perform an in-game purchase by the user (e.g. receiving a request to purchase a game, receiving a request to purchase in-game currency, receiving a request to purchase an in-game item, etc.). Accordingly, the game provider 102 may set the game trigger based on the instance of the game.

The platform account registration initiation module 116 may be configured to transmit instructions to platform provider 104 in response to a determination that the game trigger is met. The instructions may effectuate presentation of a platform registration request in a graphical user interface to the user by platform provider 104. The platform registration request may include fields where the user may enter stated information, such as a username and/or password, for the user. In implementations, in response to the presentation of the platform registration request to the user, platform account registration initiation module 116 may be configured to receive from the platform provider 104 an indication as to whether stated information was received from the user.

In response to an indication that the platform provider 104 did not receive the stated information from the user, game trigger module 114 may be configured to set a new game trigger based on the instance of the game and/or game module 110 may be configured to discontinue the instance of the game presented to the user. In response to an indication that the platform provider 104 did receive the stated information from the user, game trigger module 114 may be configured to continue the user's access to the game and may also receive information associated with a platform account for the user. The platform account for the user may include the same identifier as the game account for the user.

The platform provider 104 may be a server configured to host a plurality of games from game provider(s) 102. In implementations, platform provider 104 may be configured to register users to platform accounts which may be used to access the games from game provider 102 hosted by platform provider 104 and to execute one or more computer program modules.

In some implementations, the game provider 102, platform provider 104, client computing platforms 106, and/or external resources 124 may be operatively linked via one or more electronic communication links. For example, such electronic communication links may be established, at least in part, via a network such as the Internet and/or other networks. It will be appreciated that this is not intended to be limiting, and that the scope of this disclosure includes implementations in which game provider 102, platform provider 104 client computing platforms 106, and/or external resources 124 may be operatively linked via some other communication media.

A given client computing platform 106 may include one or more processors configured to execute computer program modules. The computer program modules may be configured to enable an expert or user associated with the given client computing platform 106 to interface with system 100 and/or external resources 124, and/or provide other functionality attributed herein to client computing platforms 106. By way of non-limiting example, the given client computing platform may include one or more of a desktop computer, a laptop computer, a handheld computer, a tablet computing platform, a NetBook, a Smartphone, a gaming console, and/or other computing platforms.

External resources 124 may include sources of information, hosts and/or providers of virtual environments outside of system 100, external entities participating with system 100, and/or other resources. In some implementations, some or all of the functionality attributed herein to external resources 124 may be provided by resources included in system 100.

Game provider 102 may include electronic storage 128, one or more processors 130, and/or other components. Game provider 102 may include communication lines, or ports to enable the exchange of information with a network and/or other computing platforms. Illustration of game provider 102 in FIG. 1 is not intended to be limiting. Game provider 102 may include a plurality of hardware, software, and/or firmware components operating together to provide the functionality attributed herein to game provider 102. For example, game provider 102 may be implemented by a cloud of computing platforms operating together as game provider 102.

Electronic storage 128 may comprise non-transitory storage media that electronically stores information. The electronic storage media of electronic storage 128 may include one or both of system storage that is provided integrally (i.e., substantially non-removable) with game provider 102 and/or removable storage that is removably connectable to game provider 102 via, for example, a port (e.g., a USB port, a firewire port, etc.) or a drive (e.g., a disk drive, etc.). Electronic storage 124 may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. Electronic storage 128 may include one or more virtual storage resources (e.g., cloud storage, a virtual private network, and/or other virtual storage resources). Electronic storage 102 may store software algorithms, information determined by processor 130, information received from game provider 102, information received from client computing platforms 106, and/or other information that enables game provider 102 to function as described herein.

Processor(s) 130 is configured to provide information processing capabilities in game provider 102. As such, processor 130 may include one or more of a digital processor, an analog processor, a digital circuit designed to process information, an analog circuit designed to process information, a state machine, and/or other mechanisms for electronically processing information. Although processor 130 is shown in FIG. 1 as a single entity, this is for illustrative purposes only. In some implementations, processor 130 may include a plurality of processing units. These processing units may be physically located within the same device, or processor 130 may represent processing functionality of a plurality of devices operating in coordination. The processor 130 may be configured to execute modules 108, 110, 112, 114, and 116. Processor 130 may be configured to execute modules 108, 110, 112, 114, and 116 by software; hardware; firmware; some combination of software, hardware, and/or firmware; and/or other mechanisms for configuring processing capabilities on processor 130. As used herein, the term "module" may refer to any component or set of components that perform the functionality attributed to the module. This may include one or more physical processors during execution of processor readable instructions, the processor readable instructions, circuitry, hardware, storage media, or any other components.

It should be appreciated that although modules 108, 110, 112, 114, and 116 are illustrated in FIG. 1 as being implemented within a single processing unit, in implementations in which processor 130 includes multiple processing units, one or more of modules 108, 110, 112, 114, and 116 may be implemented remotely from the other modules. The description of the functionality provided by the different modules 108, 110, 112, 114, and 116 described below is for illustrative purposes, and is not intended to be limiting, as any of modules 108, 110, 112, 114, and 116 may provide more or less functionality than is described. For example, one or more of modules 108, 110, 112, 114, and 116 may be eliminated, and some or all of its functionality may be provided by other ones of modules 108, 110, 112, 114, and 116. As another example, processor 130 may be configured to execute one or more additional modules that may perform some or all of the functionality attributed below to one of modules 108, 110, 112, 114, and 116

Figure 2:
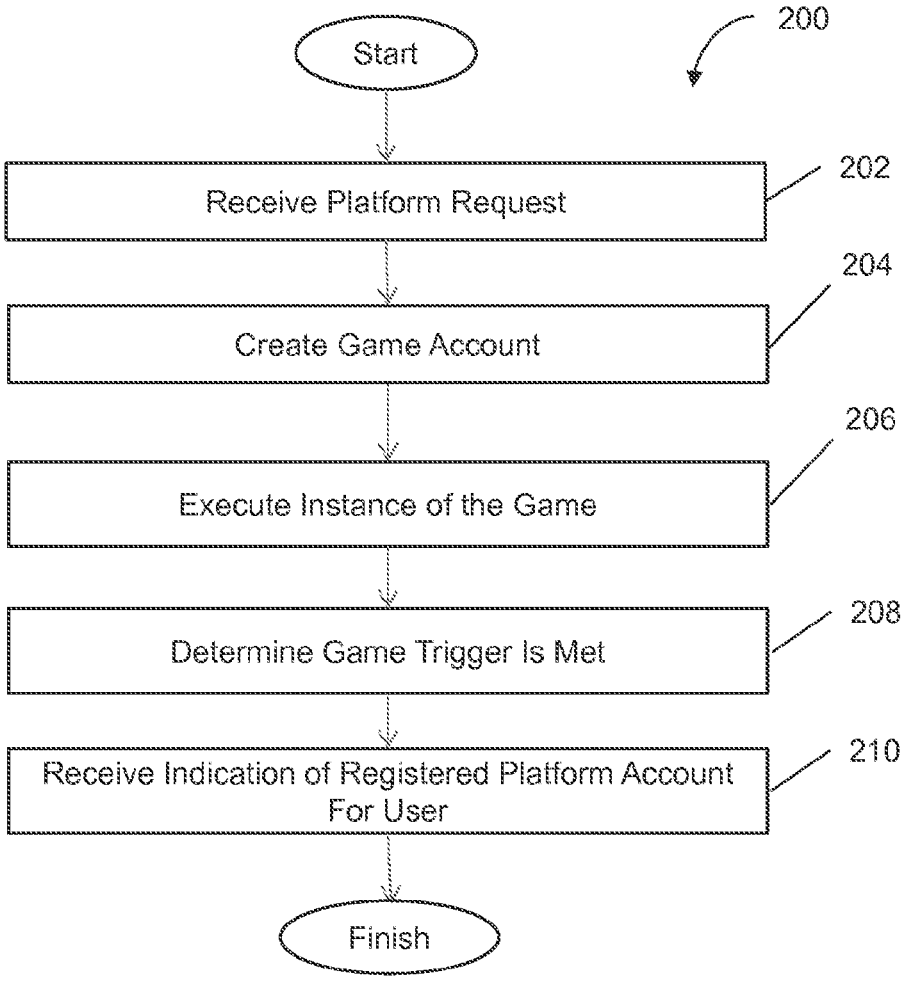
FIG. 2 illustrates a method of registering a user to a platform account for a platform provider hosting a game provider, in response to a game trigger being met, in accordance with one or more implementations.

FIG. 2 illustrates a method of registering a user to a platform account for a platform provider hosting a game provider, in response to a game trigger being met. The operations of method 200 presented below are intended to be illustrative. In some embodiments, method 200 may be accomplished with one or more additional operations not described, and/or without one or more of the operations discussed. Additionally, the order in which the operations of method 200 are illustrated in FIG. 2 and described below is not intended to be limiting.

In some embodiments, method 200 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 200 in response to instructions stored electronically on an electronic storage medium. The one or more processing devices may include one or more devices configured through hardware, firmware, and/or software to be specifically designed for execution of one or more of the operations of method 200.

At an operation 202, a platform request may be received by a game provider to provide access for a user to a game. The platform request may include data indicating that the user is not registered to a platform account for a platform provider. Operation 202 may be performed by a platform request reception module that is the same as or similar to platform request reception module 108, in accordance with one or more implementations.

At an operation 204, a game account may be created for the user. The game account may be associated with an identifier associated with the platform request. In some implementations, this operation may be skipped. Operation 204 may be performed by a game module that is the same as or similar to game module 110, in accordance with one or more implementations.

At an operation 206, an instance of the game may be executed to provide access to the game for the user in response to receiving the platform request. Responsive to providing the user access to the game, the user may input action request to specify executions of in-game actions. The in-game actions may then be implemented in the instance of the game. Operation 206 may be performed by a game module that is the same as or similar to game module 110, in accordance with one or more implementations.

At an operation 208, it may be determined if a game trigger for the user is met based on the instance of the game. The game trigger may be determined by the game provider of the game, and may vary from game to game and/or game provider to game provider. The game trigger may be associated with an amount of time that the instance of the game is presented to the user (e.g. one minute, ten minutes, one hour, or any length of time), in-game actions performed by the user (e.g. a user reaching a certain level in-game, completing a tutorial in-game, etc.), the user's progress towards an in-game achievement (e.g. unlocking a trophy, badge, award, stamp medal, challenge, etc.) and/or an receiving a request to perform an in-game purchase by the user (e.g. receiving a request to purchase a game, receiving a request to purchase in-game currency, receiving a request to purchase an in-game item, etc.). Operation 208 may be performed by a game trigger module that is the same as or similar to game trigger module 114, in accordance with one or more implementations.

At an operation 210, instructions may be transmitted to a platform provider in response to a determination that the game trigger is met. The instructions may effectuate presentation of a platform registration request to the first user by the platform provider. In implementations, the platform registration request may be presented in a graphical user interface with fields where the user may enter stated information. In response to receiving the platform registration request, the user may enter stated information within the fields of the graphical user interface and a platform account may be registered for the user. The registered platform account for the user may be utilized to provide the user access to the games from game providers hosted on by the platform provider. Operation 210 may be performed by a platform account registration initiation module that is the same as or similar to platform account registration initiation module 116, in accordance with one or more implementations.

Figure 3:
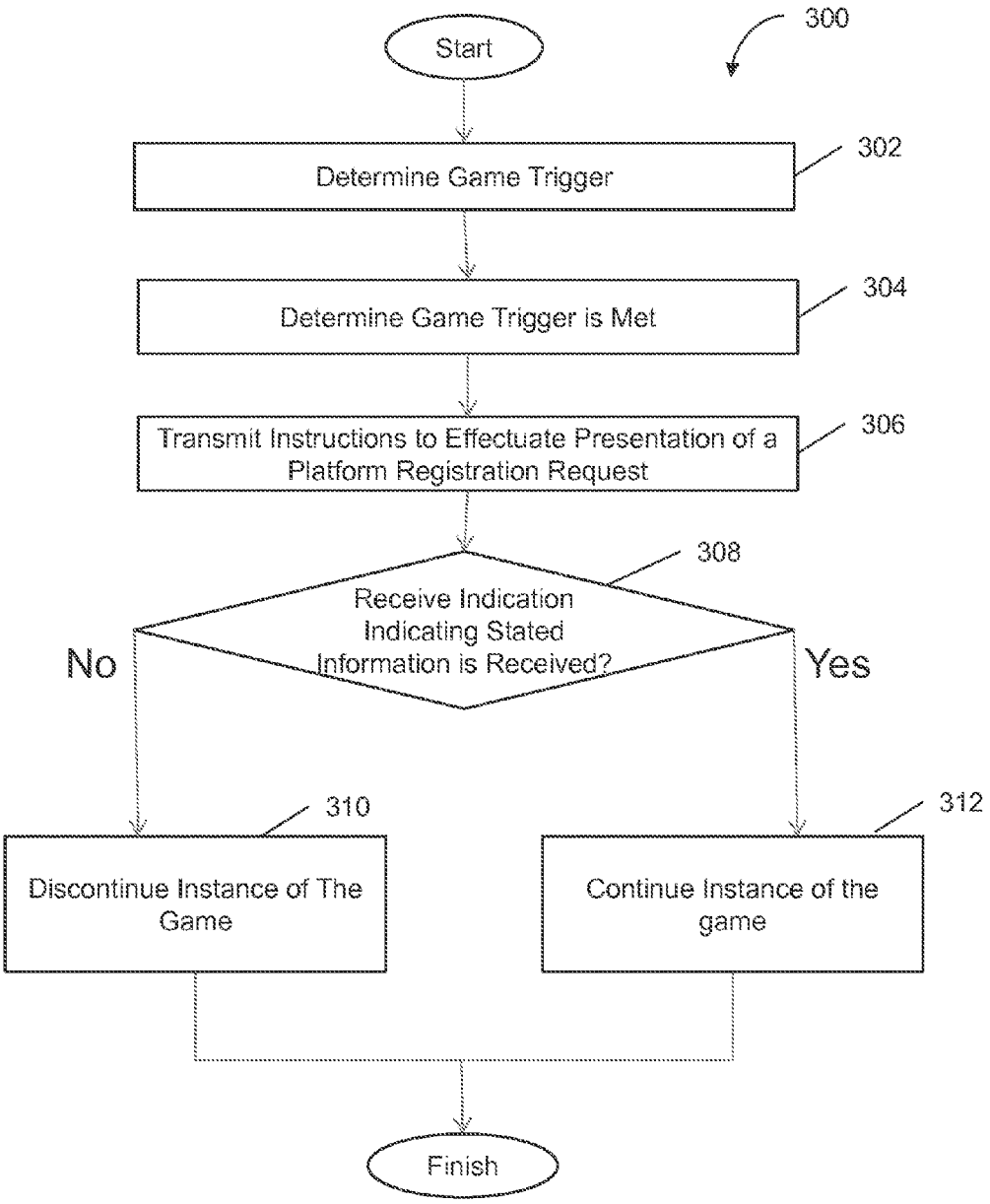
FIG. 3 illustrates a method of registering a user to a platform account for a platform provider hosting games from a game provider, in accordance with one or more implementations.

FIG. 3 illustrates a method of registering a user to a platform account for a platform provider responsive to a game trigger being met. The operations of method 300 presented below are intended to be illustrative. In some embodiments, method 300 may be accomplished with one or more additional operations not described, and/or without one or more of the operations discussed. Additionally, the order in which the operations of method 300 are illustrated in FIG. 3 and described below is not intended to be limiting.

In some embodiments, method 300 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 300 in response to instructions stored electronically on an electronic storage medium. The one or more processing devices may include one or more devices configured through hardware, firmware, and/or software to be specifically designed for execution of one or more of the operations of method 300.

At an operation 302, a game trigger may be determined by the game provider for the game. The game trigger may be utilized to effectuate presentation of a platform registration request to a user that is not registered to a platform account. The game trigger may be associated with an instance of the game, and may vary from game to game and/or game provider to game provider. In implementations, the game trigger determined based on an amount of time that the instance of the game is presented to a user (e.g. one minute, ten minutes, one hour, or any length of time), in-game actions performed by a user (e.g. a user reaching a certain level in-game, completing a tutorial in-game, etc.), the user's progress towards an in-game achievement (e.g. unlocking a trophy, badge, award, stamp medal, challenge, etc.) and/or an receiving a request to perform an in-game purchase by the user (e.g. receiving a request to purchase a game, receiving a request to purchase in-game currency, receiving a request to purchase an in-game item, etc.). Operation 302 may be performed by a game trigger module that is the same as or similar to game trigger module 114, in accordance with one or more implementations.

At an operation 304, it may be determined that the game trigger for the user without a registered platform account is met based on the instance of the game. Operation 304 may be performed by a game trigger module that is the same as or similar to game trigger module 114, in accordance with one or more implementations.

At an operation 306, instructions may be transmitted to a platform provider in response to a determination that the game trigger is met. The instructions may effectuate presentation of a platform registration request to the first user by the platform provider. In implementations, the platform registration request may be presented in a graphical user interface with fields where the user may enter stated information. Operation 306 may be performed by a platform account registration initiation module that is the same as or similar to platform account registration initiation module 116, in accordance with one or more implementations.

At an operation 308, a determination may be made if an indication as to whether stated information was received from the user in response to the presentation of the platform registration request to the first user by the platform provider. Operation 308 may be performed by a platform account registration initiation module that is the same as or similar to platform account registration initiation module 116, in accordance with one or more implementations.

At an operation 310, responsive to a determination at operation 308 that stated information was not received from the user, the game provider may discontinue the instance of the game and/or set a new game trigger. Operation 310 may be performed by a game module that is the same as or similar to platform account game module 110 and/or a game trigger module that is the same as or similar to game trigger module 114, in accordance with one or more implementations.

At an operation 312, responsive to a determination at operation 308 that stated information was received from the user, the user may continue to have access to the game without resetting of the game trigger. Further, the stated information may be received by the game provider. Operation 204 may be performed by a game module that is the same as or similar to game module 110, in accordance with one or more implementations.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A system for triggering registration to an online game platform by a game provider of an online game, the system comprising:

one or more processors configured by machine-readable instructions to:

receive platform requests to provide access for the users to the online game, the platform requests including a first platform request to provide access for a first user to the online game, the first platform request indicating that the first user is not registered to a platform account;

execute an instance of the online game and to use the instance of the online game to generate game state information that is transmitted to the client computing platforms over the network, and to provide access to the online game for the first user in response to the first platform request, and wherein execution of the instance of the game includes performing in-game actions in the instance of the online game in response to action requests for the in-game actions received over the network from the client computing platforms including the first client computing platform associated with the first user;

obtain the action requests input by users, wherein the action requests includes first action requests that specify execution of the in-game actions by the first user;

determine if a game trigger for the first user is met based on the instance of the online game; and transmit instructions over the network to a platform provider in response to a determination that the game trigger is met, the instructions effectuating presentation of a platform registration request to the first user by the platform provider;

receive from the platform provider an indication as to whether stated information was received from the first user in response to the presentation of the platform registration request to the first user by the platform provider; and setting a new game trigger for triggering the platform registration request in response to an indication that the stated information was not received from the first user.

2. The system of claim 1, wherein the platform requests include associated identifiers, and wherein the one or more processors are further configured by machine-readable instructions to create a game account for the first user associated with the first platform request's associated identifier.

3. The system of claim 1, wherein the one or more processors are further configured by machine-readable instructions to discontinue the instance of the online game in response to an indication that the stated information was not received from the first user.

4. The system of claim 1, wherein the game trigger is associated with an amount of time that the instance of the game is presented to the first user.

5. The system of claim 1, wherein the game trigger is associated with in-game actions performed by the first user.

6. The system of claim 1, wherein the game trigger is associated with the first user's progress towards an in-game achievement.

7. The system of claim 1, wherein the game trigger is associated with an in-game purchase by the first user.

8. A computer-implemented method for registering users, the method being implemented in a computer system that includes one or more processors executing machine-readable instructions, the method comprising:

receiving platform requests to provide access for users to an online game, the platform requests including a first platform request to provide access for a first user to the online game, the first platform request indicating that the first user is not registered to a platform account;

executing an instance of the online game and using the instance of the online game to generate game state information that is transmitted to the client computing platforms over the network, and to provide access to the online game for the first user in response to the first platform request;

implementing in-game actions in the instance of the online game in response to action requests for the in-game actions received over the network from the client computing platforms including the first client computing platform associated with the first user;

obtaining action requests input by users, wherein the action requests specify execution of the in-game actions by the user;

determining if a game trigger for the first user is met based on the instance of the online game; and transmitting instructions, over the network, to a platform provider in response to a determination that the game trigger is met, the instructions effectuating presentation of a platform registration request to the first user by the platform provider;

receiving from the platform provider an indication as to whether stated information was received from the first user in response to the presentation of the platform registration request to the first user by the platform provider; and setting a new game trigger for triggering the platform registration request in response to an indication that the stated information was not received from the first user.

9. The method of claim 8, wherein the platform requests include associated identifiers, further comprising creating a game account for the first user associated with the first platform request's associated identifier.

10. The method of claim 8, further comprising:

discontinuing the instance of the online game in response to an indication that the stated information was not received from the first user.

11. The method of claim 8, wherein the game trigger is associated with an amount of time that the instance of the online game is presented to the first user.

12. The method of claim 8, wherein the game trigger is associated with in-game actions performed by the first user.

13. The method of claim 8, wherein the game trigger is associated with the first user's progress towards an in-game achievement.

14. The method of claim 8, wherein the game trigger is associated with an in-game purchase by the first user.

* * * * *